US011548286B2

(12) United States Patent
Butinya et al.

(10) Patent No.: US 11,548,286 B2
(45) Date of Patent: Jan. 10, 2023

(54) DUMMY CARTRIDGE ACCESSORY DEVICE

(71) Applicant: HEWLETT-PACKARD DEVELOPMENT COMPANY, L.P., Spring, TX (US)

(72) Inventors: David Butinya, Sant Cugat del Valles (ES); Joan Albert Miravet Jimenez, Sant Cugat del Valles (ES); Marta Coma Vives, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/978,598

(22) PCT Filed: Mar. 8, 2018

(86) PCT No.: PCT/US2018/021573
§ 371 (c)(1),
(2) Date: Sep. 4, 2020

(87) PCT Pub. No.: WO2019/172914
PCT Pub. Date: Sep. 12, 2019

(65) Prior Publication Data

US 2021/0031534 A1 Feb. 4, 2021

(51) Int. Cl.
*B41J 2/175* (2006.01)
*B41J 2/18* (2006.01)

(52) U.S. Cl.
CPC ..... *B41J 2/17523* (2013.01); *B41J 2/17503* (2013.01); *B41J 2/17509* (2013.01); *B41J 2/18* (2013.01)

(58) Field of Classification Search
CPC .... B41J 2/175; B41J 2/17503; B41J 2/17506; B41J 2/17509; B41J 2/1752; B41J 2/17523; B41J 2/1754; B41J 2/18
See application file for complete search history.

(56) References Cited

U.S. PATENT DOCUMENTS 5,815,182 A 9/1998 Otis
5,877,795 A 3/1999 Gragg
5,971,529 A 10/1999 Pawlowski
(Continued)

FOREIGN PATENT DOCUMENTS

CN 1688445 10/2005
CN 1865009 11/2006
(Continued)

OTHER PUBLICATIONS

Wenlong Li, The Printing Principle, Use and Maintenance of Canon BJ—Series Printer, Computer & Peripherals, Sep. 15, 1999, 69-71, 05, China.
(Continued)

*Primary Examiner* — Anh T Vo

(57) ABSTRACT

A device includes a fluid channel connecting a pair of ports and an attachment feature to attach the device at a dummy cartridge; wherein the pair of ports is dimensioned to mate with fluid feed ports of a printer when the device is attached to the dummy cartridge and the dummy cartridge is inserted in the printer.

20 Claims, 5 Drawing Sheets

(56) References Cited

U.S. PATENT DOCUMENTS

| | | | | |
|---|---|---|---|---|
| 6,019,465 | A * | 2/2000 | Shinada | B41J 2/17513 347/93 |
| 6,540,343 | B1 * | 4/2003 | Umeyama | B41J 2/17503 347/93 |
| 6,572,214 | B2 | 6/2003 | Otis | |
| 7,497,562 | B2 | 3/2009 | Childs | |
| 7,533,974 | B2 * | 5/2009 | Ohnishi | B41J 2/17509 347/85 |
| 8,708,466 | B2 | 4/2014 | Mallory | |
| 8,783,654 | B2 | 7/2014 | Ang | |
| 9,623,667 | B2 | 4/2017 | Komplin | |
| 2007/0076063 | A1 | 4/2007 | Ohnishi | |
| 2008/0252701 | A1 | 10/2008 | Matsumoto | |
| 2008/0309739 | A1 * | 12/2008 | Takahashi | B41J 2/17509 347/85 |
| 2010/0157002 | A1 | 6/2010 | Takada | |
| 2016/0167384 | A1 * | 6/2016 | Hagiwara | B41J 2/165 347/44 |
| 2016/0332466 | A1 | 11/2016 | Noh | |

FOREIGN PATENT DOCUMENTS

| | | |
|---|---|---|
| CN | 1930002 | 3/2007 |
| CN | 101052528 | 10/2007 |
| CN | 101357548 | 2/2009 |
| CN | 101698374 | 4/2010 |
| CN | 102066115 | 5/2011 |
| CN | 102126350 | 7/2011 |
| CN | 203805498 | 9/2014 |
| JP | 2002292904 | 10/2002 |
| JP | 2005081689 | 3/2005 |
| JP | 2006168236 | 6/2006 |
| WO | WO-2016200388 A1 | 12/2016 |

OTHER PUBLICATIONS

Gu et al., "Diagnosis and treatment of ink-jet head block in ink-jet printer", Science & Technology Ecnony Market, Sep. 15, 2007, 122-123, 9, Chinese version only; reference originated from Chinese search report dated Mar. 2, 2022.

* cited by examiner

DUMMY CARTRIDGE ACCESSORY DEVICE

BACKGROUND

Some printing fluids used in printers include heavy pigments or heavy particles that can precipitate when the fluid is not moving in the printer. A fluid recirculation system can be used for circulating the fluid in the printer to keep the heavy pigments or heavy particles dispersed in the fluid, for example when the printer is in idle or stand-by mode between printing operations. When a printhead cartridge is removed from the printer, fluid circulation may be interrupted.

BRIEF DESCRIPTION OF DRAWINGS

Examples are described with reference to the drawings.

DESCRIPTION OF EXAMPLES

Figure 1:
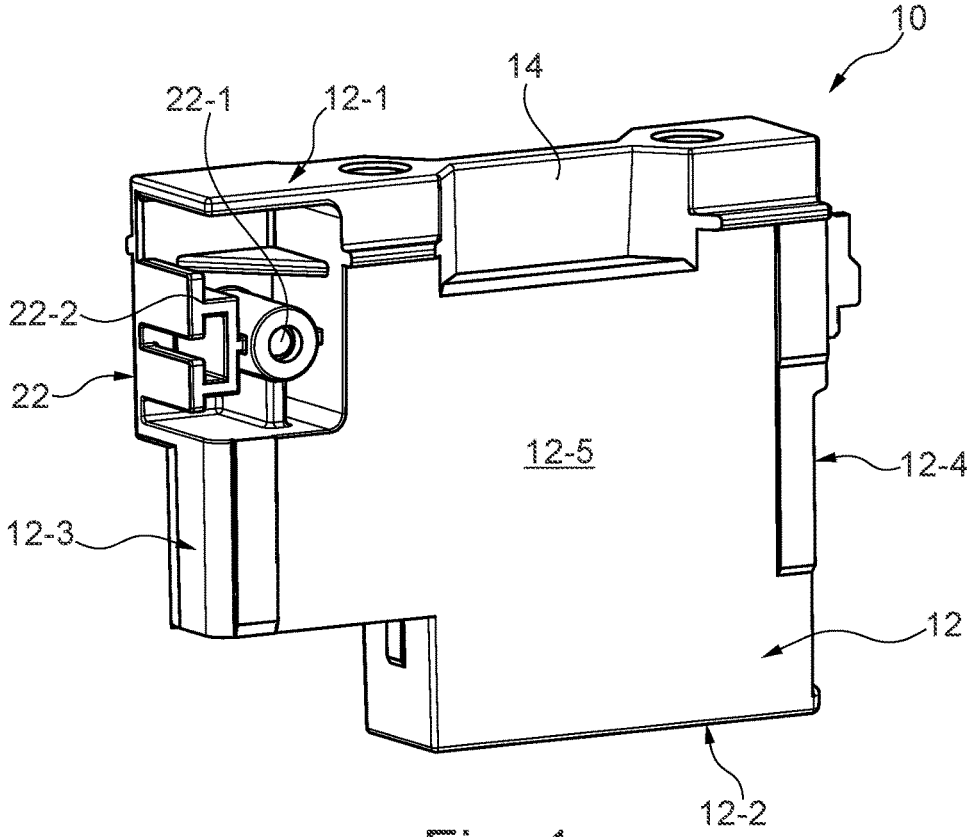
FIG. 1 shows a perspective view of a dummy cartridge, according to an example.

Inkjet 2D printers, 3D printers and plotters may include one or several printhead cartridges, each having a printhead emitting a printing fluid and a print fluid reservoir. The printhead cartridges may be supported by a movable print carriage that is reciprocatingly scanned across a print medium which is advanced between scans of the printer carriage. Printhead cartridges may be combined with a print fluid delivery systems having a print fluid supply located remotely from the carriage and coupled to the printhead cartridge reservoir by a flexible fluid conveying tube. A dummy cartridge may be used in place of the printhead cartridge in certain usage situations e.g. because not all of the printhead cartridges are needed for a certain print job.

Examples of a dummy cartridge including an accessory device which may be used to replace an inkjet printhead cartridge in a printer carriage and of a method of inserting the dummy cartridge into the printer carriage are described with reference to the drawings. Whereas different examples of dummy cartridges and accessory devices are described to comprise combinations of features, other dummy cartridges and other accessory devices may comprise some of the described features but not necessarily all of the described features in different combinations and hence may comprise different combinations or permutations of the described features.

Examples of the dummy cartridge and accessory device are described in the context of an inkjet printer using operative inkjet printhead cartridges for dispensing ink or other printing fluid. An operative inkjet printhead cartridge is a printhead cartridge having a printhead emitting a printing fluid. The operative inkjet printhead cartridge may have a print fluid reservoir and can be controlled by a printer controller for emitting ink or other printing fluid. In the following description, reference to "ink" is to be understood as a reference to ink and other printing fluids. The dummy cartridge may be used when one of the operative printhead cartridges is removed from the printer. The dummy cartridge may be used for maintaining an ink recirculation loop within the printer when an operative printhead cartridge is removed, as described below.

Operative inkjet printhead cartridges may be inserted in cartridge pockets provided in a printer carriage which includes hardware and electronics for ink supply and for controlling ink delivery and ejection to/from the printhead cartridges. For example, since the capacity of a printhead cartridge ink reservoir may be limited, off-axis or off-line ink delivery systems may be provided in a printer or externally to the printer wherein the ink supply is located remotely from the carriage and the printhead cartridge, and is coupled to the printhead cartridge reservoir by flexible ink conveying tubes. The ink supply, the ink conveying tubes and the printhead cartridges may form an ink supply loop for ink circulation and recirculation. The printer may further include a printer controller, communicating with a printhead cartridge through electrodes to deliver control signals to the printhead cartridge and/or read information from a semiconductor chip provided with the printhead cartridge.

A printer does not need some or all of the printhead cartridges during all times. For example, depending on the print job, some of the printhead cartridges may not be needed and keeping the printhead cartridges in the printer carriage could create waste ink because all of the printhead cartridges in a printer carriage will undergo certain servicing cycles, whether they are being used or not. If the printhead cartridges can be stored, while they are not used, and instead dummy cartridges are installed in the printer, no waste of ink is generated. As another example, if a cartridge pocket should be maintained or cleaned, ink delivery tubes should be purged or, more generally, a maintenance operation is to be performed, some or all of the printhead cartridges may be removed for a certain time period.

If an operative printhead cartridge is removed from the printer, it can be replaced by a dummy cartridge for protecting the cartridge pocket or for performing maintenance or cleaning operations, for example. If a dummy cartridge is installed in a cartridge pocket of the carriage, it seals the cartridge pocket and prevents aerosol entering the carriage and possibly damaging the printer electronics. A dummy cartridge may include a body having an external shape similar to an operative printhead cartridge's shape but not having ink emitting inkjet printheads or an ink reservoir.

An accessory device for a dummy cartridge may be provided, the accessory device including a fluid channel connecting a pair of ports and an attachment feature to attach the device at the dummy cartridge, wherein the pair of ports is dimensioned to mate with fluid feed ports of a printer when the device is attached to the dummy cartridge and the dummy cartridge is inserted in the printer. The accessory device may provide an ink circulation bridge which can be used in combination with the dummy cartridge to be inserted in the printer instead of the removed printhead cartridge. The ink circulation bridge can be used to keep up an ink circulation loop in the printer even when a respective printhead cartridge is removed.

The accessory device may be a small standard part having two hollow needles which are connected by a bridge channel within the device body. The hollow needles may be dimensioned to be fitted to a pair of ink supply ports of the printer. The hollow needles may be inserted into the device body or overmolded wherein the device body may be a molded or 3D printed part. The molded or 3D printed part may include a recess which is covered by a lid or cover to form the bridge channel between the two needles. The attachment feature further may be integrated into the molded or 3D printed part.

In an example, the accessory device may be attached to the dummy cartridge body by at least one of a screw, an interference fit, and a frictional connection. The accessory device and the attachment feature of the accessory device may be designed in such a way that the accessory device can be paired with different types of dummy cartridges.

Further, a dummy cartridge may be provided, the dummy cartridge comprising a dummy cartridge body designed to be inserted into a cartridge pocket of a printer, and a receiving structure to attach an accessory device, such as the accessory device described above. The dummy cartridge body further may include a handle for handling the dummy cartridge during insertion into and removal from a cartridge pocket. Also the dummy cartridge body may be a single molded or 3D printed part. In other examples, it may be possible to manufacture the dummy cartridge body by molding, using sliders or inserts, or to assemble the dummy cartridge body from several parts. If made from several parts, these parts can be joined by ultrasonic welding, for example.

The dummy cartridge may have the receiving structure to attach the accessory device, and the accessory device may be paired with the dummy cartridge to provide a fluid channel in a cartridge pocket in which an operative printhead cartridge has been replaced by the dummy cartridge.

The fluid channel of the accessory device, when connected to fluid supply ports of the printer, may form a fluid interconnect bridge, to be able to circulate ink in the ink delivery system no matter if an operative printhead cartridge is installed or not. Circulation of ink in the ink delivery system can be used to disperse pigments and particles in ink and other fluids to maintain the homogeneity of the ink. For example, printing fluids may comprise special inks, such as white inks or other types of inks containing heavy pigments or heavy particles having a tendency to precipitate in the printer if the printing fluid is not moving. Thus, printing fluid may be circulated in the printer to reduce the possibility of printing fluid precipitation and clogging in the printer. Using the accessory device in combination with the dummy cartridge, ink circulation can be maintained also when the printer is in a stand-by or idle state, with one of the operative printhead cartridge is removed, between printing operations or if not all of the printhead cartridges are needed for a certain print job.

FIG. 1 shows a perspective view of a dummy cartridge 10 according to an example. The dummy cartridge includes a dummy cartridge body 12 which may be a single molded or 3D printed part made from a plastic material. The dummy cartridge body 12, in short the "body", has an exterior shape which corresponds to or is similar to the exterior shape of an operative printhead cartridge and which is shaped to be inserted into a cartridge pocket of a printer carriage. The body 12 includes a top side 12-1 which faces upwards when the dummy cartridge 10 is inserted in a cartridge pocket; a bottom side 12-2 opposite the top side 12-2; a front side 12-3 which faces towards fluid supply ports of the printer when the dummy cartridge 10 is inserted in the cartridge pocket; a rear side 12-4 opposite the front side 12-3; and two opposite side faces 12-5, one of which can be seen in FIG. 1.

In the example of FIG. 1, the dummy cartridge body 12 includes a handle 14 which can be used for gripping the dummy cartridge 10 and inserting the dummy cartridge into and removing it from a cartridge pocket in a printer. The body 12 further may comprise an integrated receiving structure 22 for receiving an accessory device, explained in further detail below. The receiving structure 22 may include a threaded hole 22-1 and guide structures 22-2 to receive and fix different types of dummy cartridge accessory devices.

Figure 2:
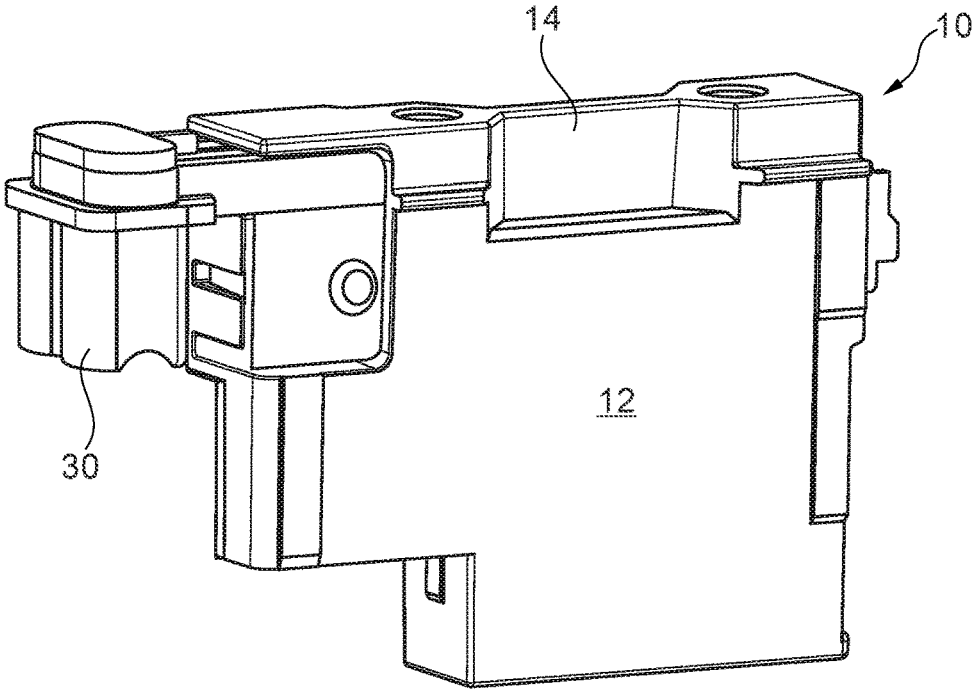
FIG. 2 shows a perspective view of the dummy cartridge of FIG. 1 in combination with an accessory device according to an example.

FIG. 2 shows a similar view as FIG. 1 wherein an accessory device 30 is installed at the receiving structure 22. Regarding the shape of the cartridge body 12 and the handle 14 as well as the receiving structure 22, reference is made to the description of FIG. 1. Whereas, some of the reference numbers used in FIG. 1 have been omitted, the same or corresponding features also can be provided in the example of FIG. 2.

The accessory device 30 of this example is a fluid interconnect bridge which may include a fluid channel connecting a pair of hollow needles, described with reference to FIG. 4A to 4F, the hollow needles serving as interconnect ports for connection to fluid supply ports of a printer, as explained below. The fluid interconnect bridge can be used to provide a closed loop of a fluid recirculation system, when an operative printhead cartridge replaced by the dummy cartridge including the accessory device 30. Circulating a printing fluid, such as ink, in a printer may help to keep heavy pigments or heavy particles dispersed in the printing fluid also when the printer is in an idle or standby mode between printing operations.

The accessory device 30 can be a small standard part which can be fitted to the receiving structure 22. It can be slid over the guide structures 22-2 and it can be fixed by a screw at the threaded hole 22-1, for example.

Figure 3:
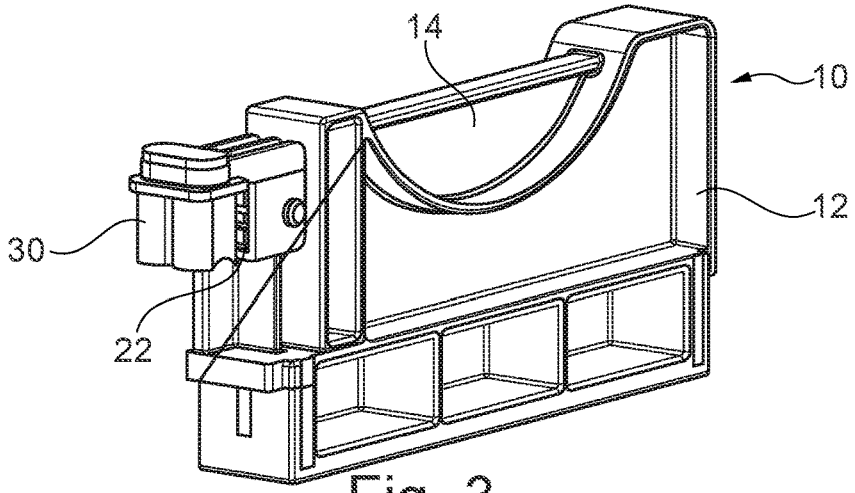
FIG. 3 shows a perspective view of another dummy cartridge in combination with an accessory device according to an example.

FIG. 3 shows a different type of dummy cartridge 10, having a dummy cartridge body 12 and an accessory device 30 attached thereto. The body 12 of the dummy cartridge 10 of FIG. 3 has a skeleton structure to provide rigidity at low weight. Similar to the dummy cartridge of FIGS. 1 and 2, it includes a handle 14 and a receiving structure 22 for receiving an accessory device 30. The receiving structure may be identical or similar to the receiving structure of the dummy cartridge of FIGS. 1 and 2 so that the same or a similar accessory device 30 may be paired also with the dummy cartridge of FIG. 3. This allows using the same accessory device 30 with different types of dummy cartridges 10.

FIG. 4A to 4F show different views of an example of an accessory device 30 which can be paired with or included in a dummy cartridge as described above or with a different type of dummy cartridge. The accessory device 30 includes a device body 32 which may be a single part, e.g. manufactured by 3D printing or molding, or which may be assembled from two or several parts which are joined by ultrasonic welding, for example.

The device body 32 includes an attachment feature 34 to attach the accessory device 30 at a dummy cartridge and, more particularly, at the receiving structure 22 of the dummy cartridge. The attachment feature 34 may comprise a guide structure 34-2 for engagement with the guide structure 22-2 of the receiving structure 22 and a hole 34-1 for fixing the accessory device 30 at the threaded hole 22-1 of the dummy cartridge by a screw, for example.

The accessory device 30 further may include a fluid channel 36 connecting a pair of tubes or hollow needles 38, the hollow needles 38 serving as interconnect ports for connection to fluid supply ports of a printer. The hollow needles 38 are dimensioned to mate with respective fluid supply ports of a printer when the dummy cartridge, with the accessory device 30 attached thereto, is inserted into a cartridge pocket of the printer. The fluid interconnect bridge can be used to provide a closed loop of a fluid recirculation system, when an operative printhead cartridge is removed and replaced by the dummy cartridge including the accessory device 30.

The channel 36 can be formed from a recess in the device body 32, the hollow needles 38 opening into the recess, wherein the recess is closed by a lid or cover 20. The cover 20 may be joined to the device body 34 by ultrasonic welding, for example, to ensure that no ink leaks from the channel 36.

The hollow needles 38 may be surrounded by hollow cylinders 42 having a chamfered inner edge 44 at their distal ends to facilitate mating the fluid interconnect bridge with fluid supply ports of a printer. The hollow needles 38 may be inserted into the device body 34 or may be formed into the device body by overmolding.

The accessory device 30 may be a standard part which can be used in combination with different dummy cartridges so that it can be installed in different types of printers with different printhead cartridge shapes. The hollow needles 38 and the channel 36 allow ink to flow in two directions without use of check valve. The hollow needles 38 may be used as inlet and outlet paths for ink circulation in both directions. This feature is useful for printers having complex ink delivery systems, which move the ink back and forth.

Figure 4A:
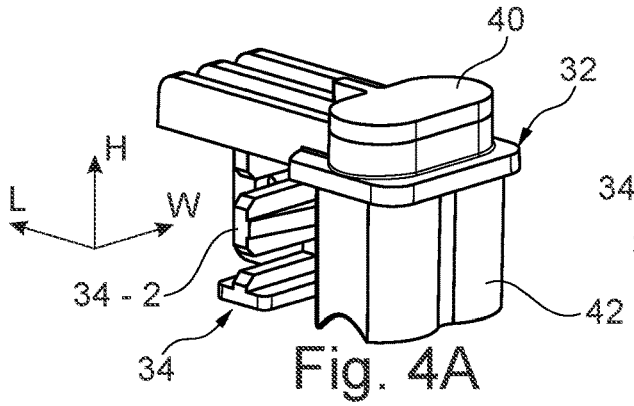
FIG. 4A shows a perspective view of an accessory device according to an example.
Figure 4B:
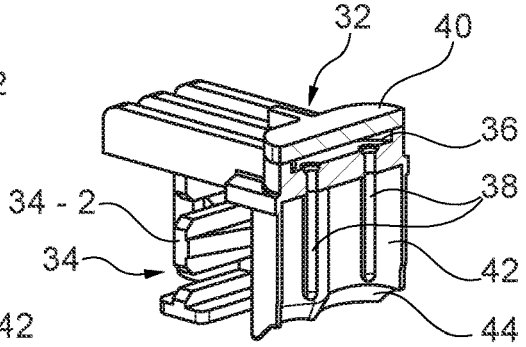
FIG. 4B shows a similar view of the accessory device as FIG. 4A, with a part of the accessory device cut away.
Figure 4C:
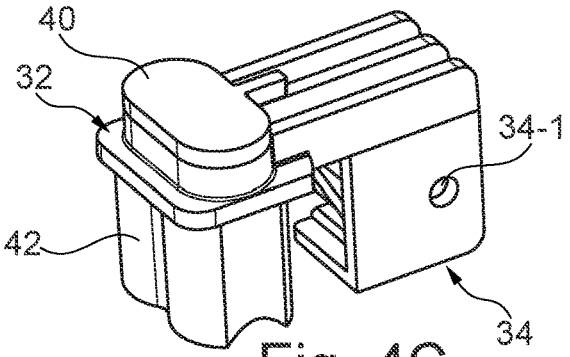
FIG. 4C shows another perspective view of the accessory device of FIG. 4A, from an opposite side.
Figure 4D:
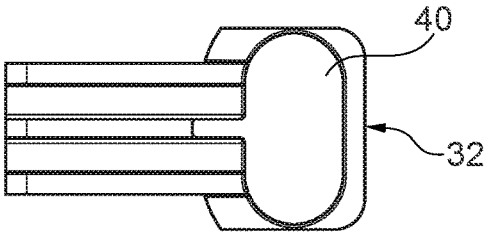
FIG. 4D shows a top view of the accessory device of FIG. 4A.
Figure 4E:
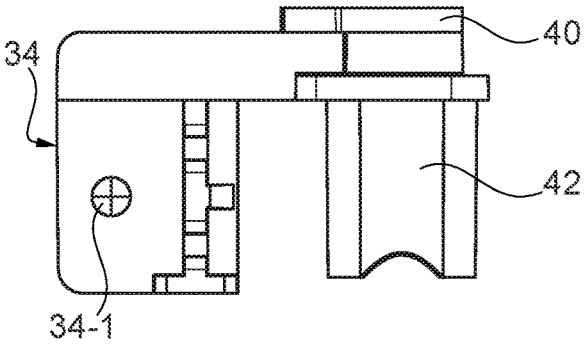
FIG. 4E shows a side view of the accessory device of FIG. 4A.
Figure 4F:
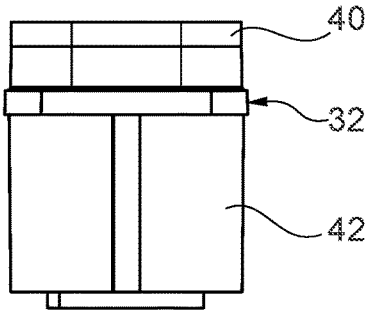
FIG. 4F shows a front view of the accessory device of FIG. 4A.

The accessory device 30 is a passive part which simply is attached to a dummy cartridge to be installed in a printer, with no power or control needed. The accessory device 30 may be reusable in combination with the same type and different types of dummy cartridges. The accessory device 30 can have small dimensions so that it can be used in combination with a wide range of dummy cartridge sizes. The accessory device, in an example, can have outer dimensions of height "H"×width "W"×length "L" of about 20 mm×20 mm×35 mm. The respective dimensions H, W, and L are illustrated in FIG. 4A.

Figure 5:
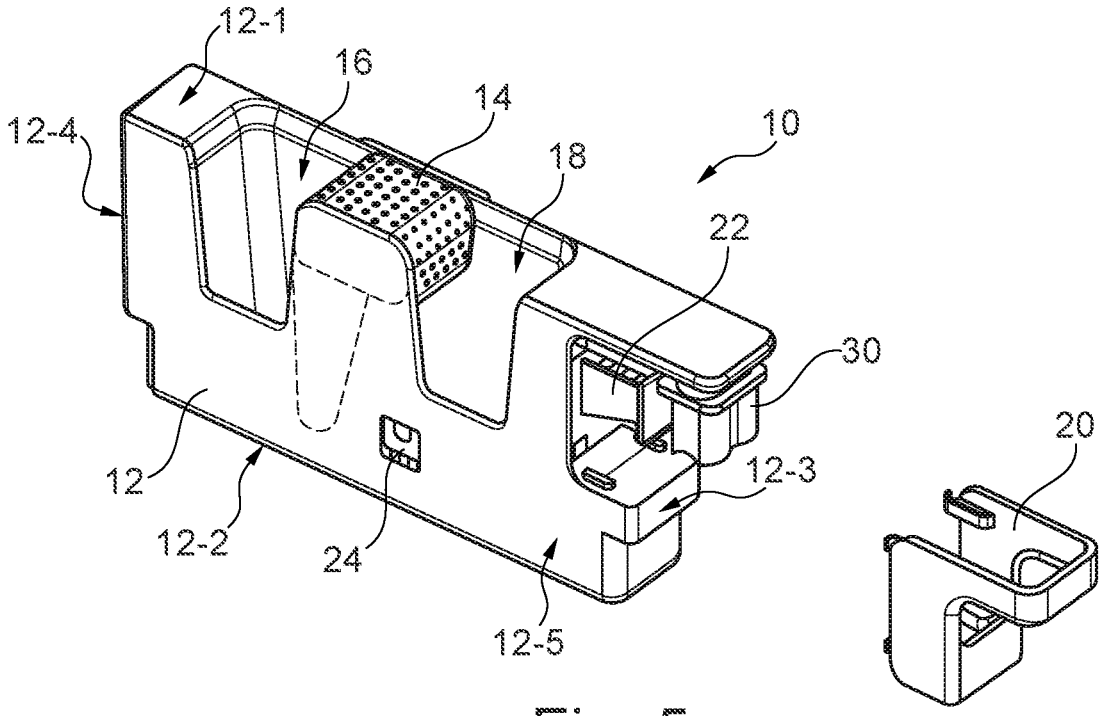
FIG. 5 shows a perspective view of another dummy cartridge, in combination with an accessory device according to another example.

FIG. 5 shows a perspective view of a different type of dummy cartridge 10 and an associated cover 20 according to an example. The dummy cartridge includes a dummy cartridge body 12 which may be a single molded or 3D printed part made from a plastic material. The dummy cartridge body 12, in short the "body", has an exterior shape which corresponds to or is similar to the exterior shape of an operative printhead cartridge which is shaped to be inserted into a cartridge pocket of a printer carriage. The body 12 includes a top side 12-1 which faces upwards when the dummy cartridge 10 is inserted in a cartridge pocket; a bottom side 12-2 opposite the top side 12-2; a front side 12-3 which faces towards fluid supply ports of the printer when the dummy cartridge 10 is inserted in the cartridge pocket; a rear side 12-4 opposite the front side 12-3; and two opposite side faces 12-5, one of which can be seen in FIG. 5.

In the example of FIG. 5, the dummy cartridge body 12 includes a handle 14 integrated into the dummy cartridge body 12, with cavities 16, 18 provided in the dummy cartridge body on two opposite sides of the handle 14. The cavities 16, 18 are dimensioned to allow insertion of a human thumb and/or finger on the two opposite sides of the handle for gripping the handle 14. In the example, the cavities 16, 18 are provided to the rear and to the front of the handle 14. The handle 14 may be located at or near the center of gravity of the body 12 or it may be offset from the center of gravity towards the rear side 12-4 of the body 12 to balance a holding force of fluid supply ports connected to an accessory device of the dummy cartridge. The handle 14 can occupy space within the body 12 of the dummy cartridge which, in an operative printhead cartridge, may be occupied by a fluid reservoir.

The handle may be formed as a bridge between the two opposite side faces of the dummy cartridge 10 and may have a block shape or an inverted "L" shape, for example. Two possible shapes of the handle 14 within the body 12 are illustrated by differently dashed lines in FIG. 5. The inverted L shape of the handle 14 may include a shorter leg and a longer leg connected at a corner of the L shaped handle; wherein the shorter leg is located near the top side of the body 12 and extends from the corner towards the front side 12-3 of the body 12, and wherein the longer leg extends from the corner 14-3 towards the bottom side 12-2 of the body. If formed to have a block shape, the block shaped handle may be located at the top side of the body 12, as shown in FIG. 5. An undercut may be formed below the handle 14 which can be gripped by a human finger or thumb when pulling the dummy cartridge 10 from a cartridge pocket.

The cavities 16, 18 may extend from the top side 12-1 towards the bottom side 12-2 of the body 12 and may extend over part of or substantially the entire height of the dummy cartridge. Each of them may have an opening at the top side 12-1 of the body 12, the opening having an area which is sufficiently big to allow insertion of a human finger or thumb.

The handle further may have a structured surface to provide for a nonslip surface and hence a safe grip when gripping the handle 14. The structure on the surface of the handle may be provided by an array of raised features, such as raised dots, straight or curved lines.

The body 12 further comprises an integrated receiving structure 22 for receiving an accessory device 30, as shown in FIG. 5. The receiving structure 22 may include a threaded hole 22-1 and guide structures 22-2 to receive and fix the accessory device 30. Each one of the dummy cartridges shown in the examples of FIGS. 1, 2, 3, and 5 as well as other dummy cartridges may have the same or a similar receiving structure for receiving the same or a similar accessory device.

In different examples, the dummy cartridge 10 also may include a cover 20 having a series of clips to attach and remove the cover 20 from the dummy cartridge body 12. When the cover 20 is installed, the receiving structure 22 is hidden and protected.

In different examples, the dummy cartridge may further include a memory for storing information about at least one of the type and usage of the dummy cartridge. The memory may be integrated into a semiconductor chip 24, the semiconductor chip 24 further including a controller. An example of a semiconductor chip 24 is shown in FIG. 5 where it is located at one of the side faces 12-5 of the dummy cartridge body 12. The chip 24 may be compatible with printer electronics for communicating information, such as a version of the dummy cartridge, whether it is an original part, the number of insertions, the type of accessory device installed. This information can be used by the printer to detect that a dummy cartridge has been inserted in the cartridge pocket and to detect that the accessory device is attached to the dummy cartridge to control actions of the printer, using the accessory device, such as ink recirculation.

Figure 6A:
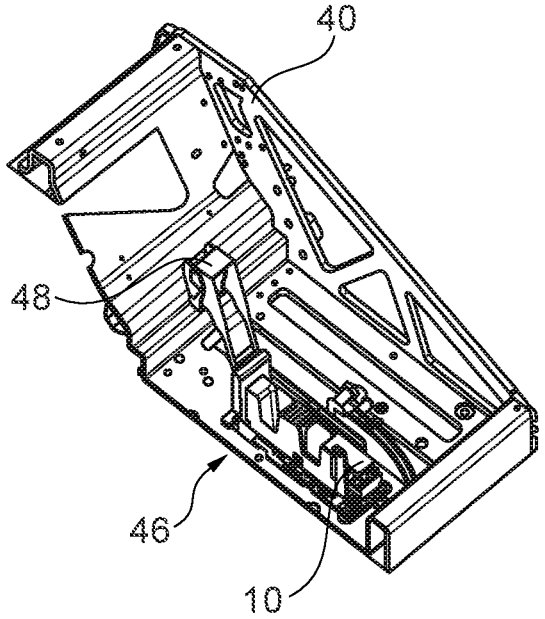
FIGS. 6A and 6B show perspective views of part of a printer carriage of an inkjet printer, including a cartridge pocket according to an example.
Figure 6B:
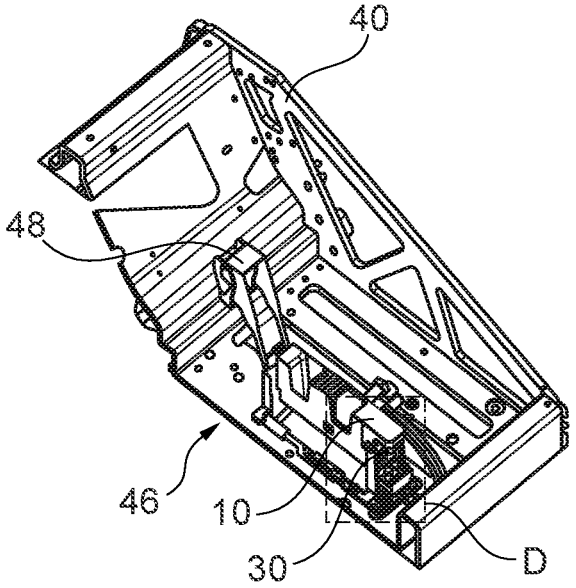
Figure 6C:
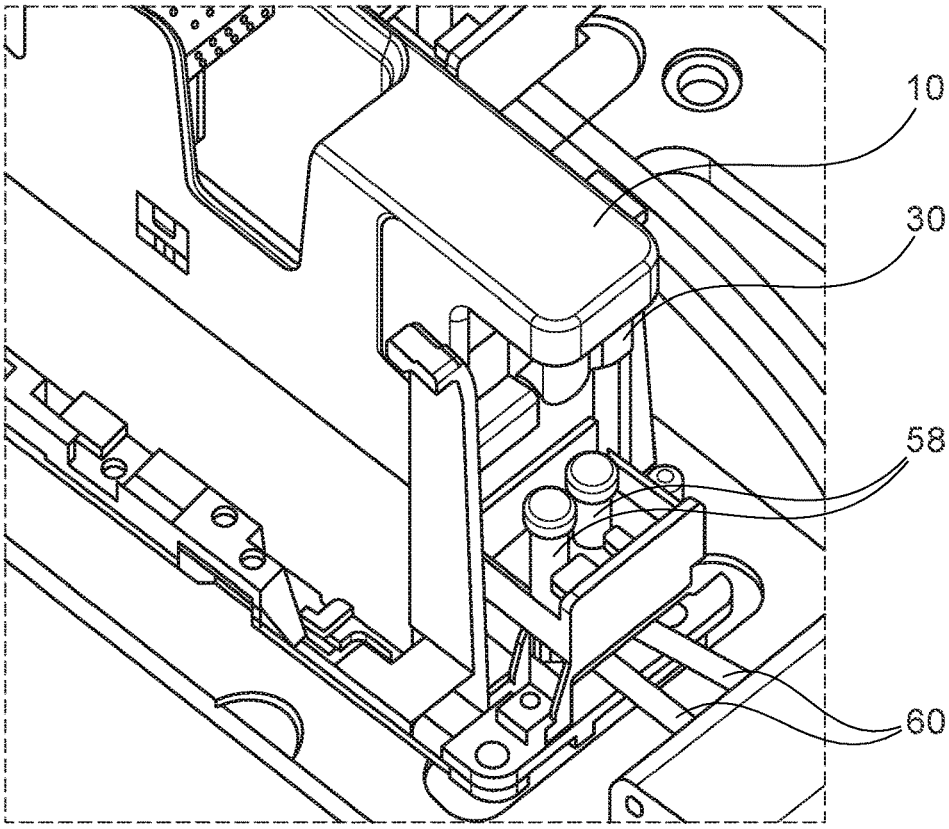
FIG. 6C shows an enlarged detail of FIG. 6B, taken at rectangle D in FIG. 6B.

FIGS. 6A and 6B show perspective views of part of a printer carriage of an inkjet printer, including a cartridge pocket according to an example. FIG. 6C shows an enlarged detail of FIG. 6B, at rectangle D in FIG. 6B. Whereas, the printer carriage 40 may include several cartridge pockets, e.g. five cartridge pockets, one of the cartridge pockets is shown at 46. Each cartridge pocket may receive an operative printhead cartridge or a dummy cartridge wherein a dummy cartridge 10 is illustrated in FIG. 6A to 6C. In FIG. 6A, the dummy cartridge 10 is fully inserted in cartridge pocket 46 and, in FIGS. 6B and 6C, the dummy cartridge 10 is partially inserted in cartridge pocket 46. The dummy cartridges 10 has an accessory device 30 mounted thereto such as the fluid interconnect bridge illustrated above. The carriage further includes a pivotable cover 48 to be closed on an operative printhead cartridge or dummy cartridge after it has been inserted into the respective cartridge pocket.

FIGS. 6B and 6C illustrate two fluid supply ports 58 connected to fluid supply tubes 60 for supplying a printing fluid to a printhead cartridge. The fluid supply ports 58 each include a septum into which a respective needle 38 of the fluid interconnect bridge may be inserted. In FIG. 6A, the dummy cartridge 10 is fully inserted so that the fluid supply ports 58 and the respective needles 38 of the fluid interconnect bridge of the accessory device 30 are engaged. In FIGS. 6B and 6C, the dummy cartridge 10 is partially inserted, wherein the fluid supply ports 58 and the respective needles 38 of the fluid interconnect bridge 30 are disengaged.

When a dummy cartridge 10, having an accessory device 30 mounted thereto, is installed in one of the cartridge pockets 46, the fluid interconnect bridge of the accessory device 30 may be used for two-way circulation of ink through the printer. One of the fluid supply ports 58 feeds ink to the cartridge and acts as an inlet and the other one receives ink which flows through the two needles 38 and the channel 36 and acts as an outlet and vice versa.

Figure 7:
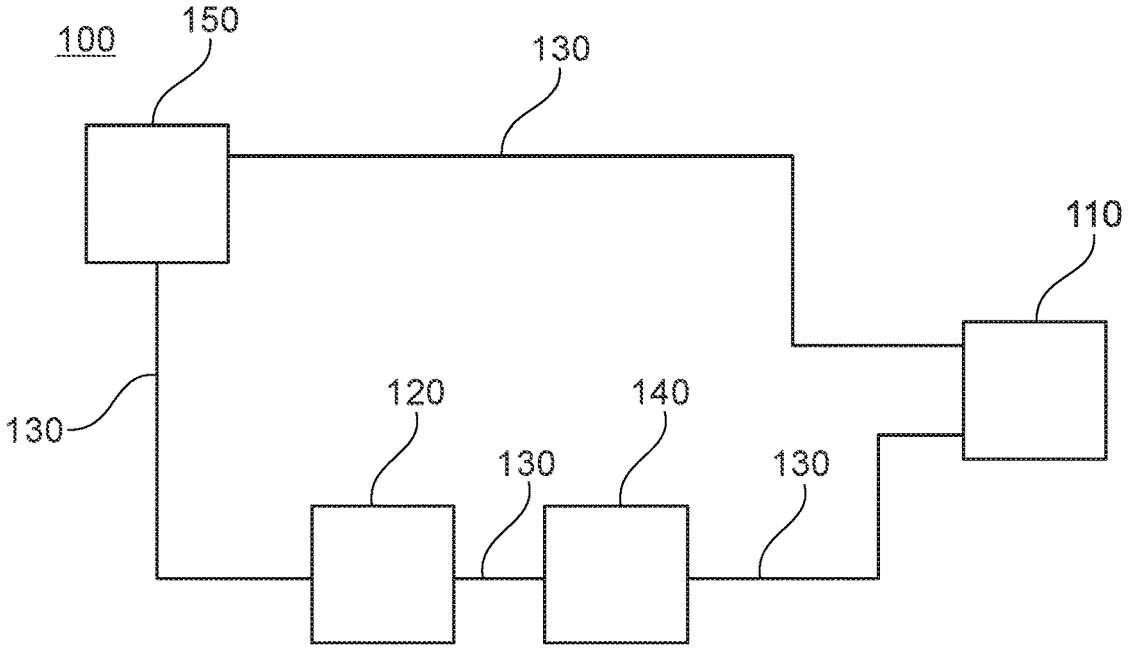
FIG. 7 shows a printer comprising a fluid channel for circulating the fluid, including a dummy cartridge according to an example.

FIG. 7 shows an example of a printer 100 having a dummy cartridge 110, to which an accessory device is mounted, installed therein for ink recirculation. An ink loop includes a fluid channel 130 and a fluid pump 120, wherein the fluid channel 130 provides fluid communication between the fluid pump 120 and the dummy cartridge 110 for enabling fluid recirculation in the printer 100. The flow channel 130 can be arranged in a ring structure to couple the fluid interconnect bridge of the accessory device of the dummy cartridge 110 and fluid pump 120 in a loop, allowing the fluid pump 120 to apply pressure to the fluid so as to move the fluid in a circle. The printer also can include a plurality of printhead cartridges and dummy cartridges, each coupled to the flow channel 130.

The fluid conveyed in the flow channel 130 may represent ink, for example ink containing heavy pigments or heavy particles, such as white ink including titanium dioxide in its pigments. Ink can tend to precipitate when the ink is not moving and thus can cause the settling of pigments and particles deteriorating the performance of printer components making contact with the ink. The fluid recirculation in the printer can be used to circulate the ink to reduce the possibility of ink precipitation and clogging the printer. Moreover, printing quality can depend on the homogeneity of ink being disposed on a print medium, and fluid recirculation can support the dispersion of particles and pigments and the ink.

In an example, the printer 100 may further comprise a pressure sensor 140 and a fluid reservoir 150 to provide an ink buffer to assist control of ink pressure in the fluid channel 130.

Figure 8:
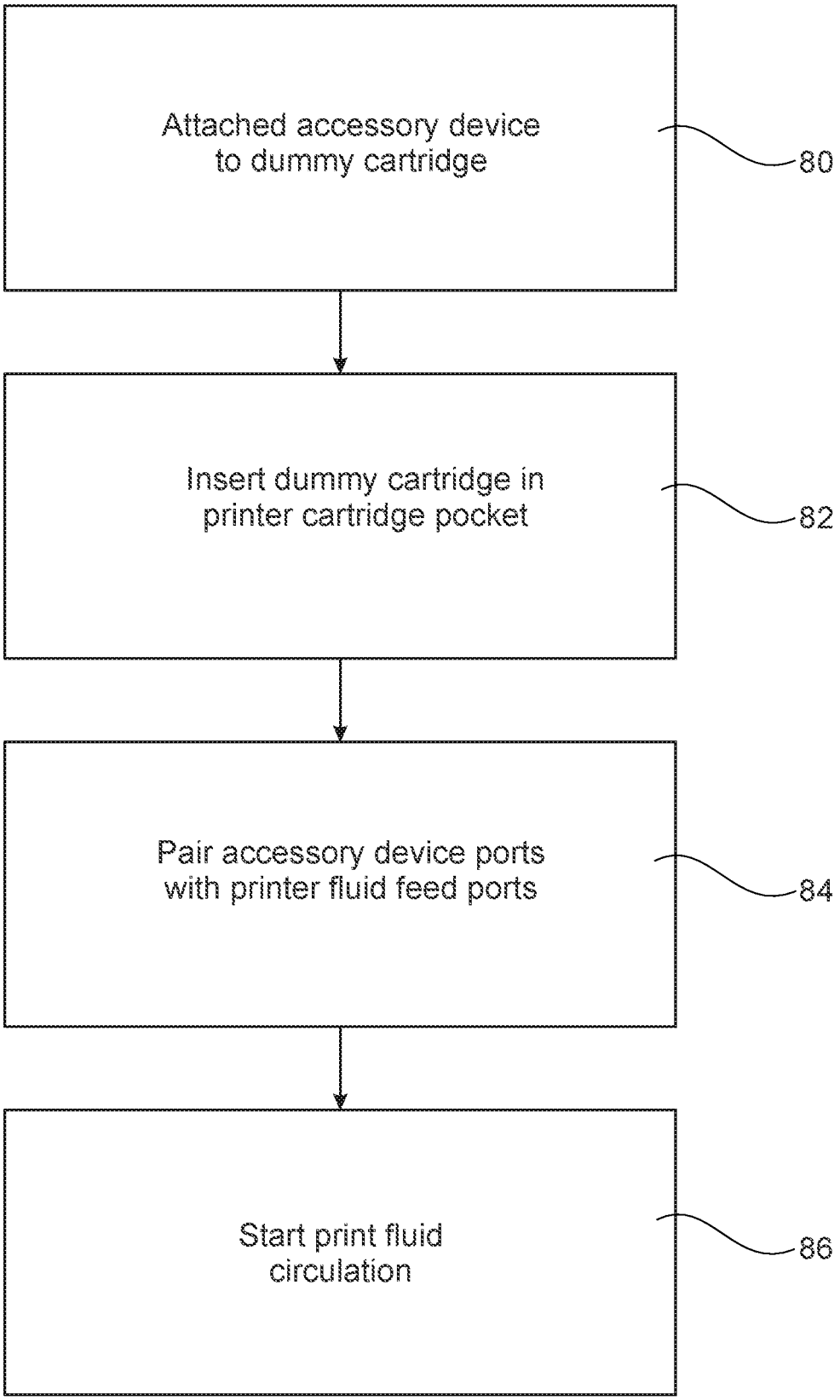
FIG. 8 shows a flow diagram of a method of inserting a dummy cartridge into a printer carriage, according to an example.

With reference to the examples described above, as shown in FIG. 8, a process according to an example may comprise inserting a dummy cartridge into a cartridge pocket of a printer, the dummy cartridge carrying an accessory device, the accessory device providing a fluid interconnect bridge having a pair of ports, at 82; and inserting the dummy cartridge may include mating the pair of ports with a pair of fluid feed points of the printer, at 84. A printing fluid circulation process may be started, at 86, wherein a printing fluid is transported through a fluid path, with the fluid interconnect bridge of the accessory device forming part of the fluid path. Before inserting the dummy cartridge into the cartridge pocket, the accessory device 30 may be connected to the dummy cartridge 10, at 80.

What is claimed is:

1. A device, comprising:

a fluid channel connecting a pair of ports; and an attachment feature to attach the device at a dummy cartridge;

wherein the pair of ports is dimensioned to mate with a fluid circulation system of a printer when the device is attached to the dummy cartridge and the dummy cartridge is inserted in the printer.

2. The device of claim 1, comprising a device body receiving two hollow needles which are connected by a bridge channel within the device body.

3. The device of claim 2 wherein the hollow needles are inserted into the device body.

4. The device of claim 2 wherein the device body is a molded or 3D printed part.

5. The device of claim 4 wherein the hollow needles are inserted or formed into the molded or 3D printed part.

6. The device of claim 4 wherein the molded or 3D printed part includes a recess which is covered by a cover to form the bridge channel.

7. The device of claim 4 wherein the attachment feature is integrated into the molded or 3D printed part.

8. The device of claim 1, wherein each port of the pair of ports comprises a hollow needle to be inserted through a septum of the printer when the dummy cartridge is inserted in the printer.

9. The device of claim 1, wherein, when the dummy cartridge is inserted in the printer, the device comprises a fluid recirculation path in which fluid is received from the printer through one port of the pair of ports, is passed through the fluid channel and is returned to the printer through the other port of the pair of ports.

10. The device of claim 1, wherein the attachment feature further comprises a guide structure corresponding to a guide structure of the dummy cartridge to guide attachment of the device by the attachment feature to the dummy cartridge.

11. The device of claim 1, wherein, when the dummy cartridge is inserted into the cartridge pocket of the printer, the pair of ports is positioned for each port to connect with the fluid circulation system of the printer such that the fluid channel is positioned to receive fluid from the printer at a first of the pair of ports and return that fluid to the printer at a second of the pair of ports.

12. A device, comprising:

a dummy cartridge body designed to be inserted into a cartridge pocket of a printer, a receiving structure; and the accessory device attached to the receiving structure;

wherein the accessory device comprises a fluid channel connecting a pair of ports; and the pair of ports positioned for each port to connect with a fluid circulation system of the printer when the dummy cartridge is inserted into the cartridge pocket of the printer;

wherein, when the dummy cartridge is inserted into the cartridge pocket of the printer, the fluid channel is arranged to receive fluid from the printer at a first of the pair of ports and return that fluid to the printer at a second of the pair of ports.

13. The device of claim 12, wherein the dummy cartridge body is a single molded or 3D printed part.

14. The device of claim 12, wherein the dummy cartridge body includes a handle for handling the dummy cartridge during insertion into and removal from the cartridge pocket.

15. The device of claim 12, wherein the accessory device is attached to the dummy cartridge body by at least one of a screw, an interference fit, and a frictional connection.

16. The dummy cartridge of claim 12, further comprising the accessory device attached to the dummy cartridge, wherein the accessory device comprises a fluid recirculation path in which fluid is received from the printer through a first port of the accessory device, is passed through a fluid channel of the accessory device, and is returned to the printer through a second port of the accessory device.

17. The dummy cartridge of claim 16, wherein the ports of the accessory device each further comprise:

a hollow needle to be received in a septum of the printer; and a hollow cylinder surrounding each hollow needle having a chamfered inner edge at a distal end to facilitate mating with a fluid supply port of the printer.

18. A method, comprising:

inserting a dummy cartridge into a cartridge pocket of a printer, the dummy cartridge carrying an accessory device, the accessory device providing a fluid interconnect bridge having a pair of ports;

wherein inserting the dummy cartridge includes mating the pair of ports with a fluid circulation system of the printer.

19. The method of claim 18, further including starting a printing fluid circulation process wherein a printing fluid is transported through a fluid path, with the fluid interconnect bridge of the accessory device forming part of the fluid path.

20. The method of claim 18, further including before inserting the dummy cartridge into the cartridge pocket, connecting the accessory device to the dummy cartridge.

* * * * *